US008275277B2

(12) United States Patent
Horita et al.

(10) Patent No.: US 8,275,277 B2
(45) Date of Patent: Sep. 25, 2012

(54) IMAGE FORMING APPARATUS

(75) Inventors: Shingo Horita, Tokyo (JP); Koichi Hashimoto, Yokohama (JP); Ryo Nakamura, Kawasaki (JP); Ryota Matsumoto, Yokohama (JP); Yukwi Hong, Hiratsuka (JP)

(73) Assignee: Canon Kabushiki Kaisha, Tokyo (JP)

( * ) Notice: Subject to any disclaimer, the term of this patent is extended or adjusted under 35 U.S.C. 154(b) by 263 days.

(21) Appl. No.: 12/816,695

(22) Filed: Jun. 16, 2010

(65) Prior Publication Data

US 2010/0322650 A1 Dec. 23, 2010

(30) Foreign Application Priority Data

Jun. 17, 2009 (JP) ..... 2009-144611
May 17, 2010 (JP) ..... 2010-113437

(51) Int. Cl.
*G03G 15/02* (2006.01)

(52) U.S. Cl. ..... 399/50; 399/174; 399/175

(58) Field of Classification Search ..... 399/38, 399/46, 50, 110, 115, 168, 174, 175
See application file for complete search history.

(56) References Cited

U.S. PATENT DOCUMENTS

| | | | | |
|---|---|---|---|---|
| 5,933,681 | A * | 8/1999 | Suzuki | 399/50 |
| 6,591,072 | B2 * | 7/2003 | Hashimoto et al. | 399/50 |
| 7,103,303 | B2 | 9/2006 | Suzuki et al. | |
| 8,023,845 | B2 * | 9/2011 | Inoue | 399/50 |
| 2002/0181965 | A1 * | 12/2002 | Shimizu et al. | 399/50 |

FOREIGN PATENT DOCUMENTS

| | | |
|---|---|---|
| JP | 11-149194 | 6/1999 |
| JP | 2001-042600 | 2/2001 |

* cited by examiner

*Primary Examiner* — Hoan Tran
(74) *Attorney, Agent, or Firm* — Fitzpatrick, Cella, Harper & Scinto

(57) ABSTRACT

An image forming apparatus includes an image bearing member; a charging device, including a rotatable magnetic particle carrying member and electroconductive magnetic particles carried on the rotatable magnetic particle carrying member, for charging the image bearing member by contacting the magnetic particles to the image bearing member; a measuring device for measuring magnitudes of a first force in a first direction and a second force in a second direction which are produced in a contact region between the image bearing member and the magnetic particles, wherein the first direction and second direction are independent from each other; and a control device for controlling an image forming operation on the basis of the forces measured by the measuring device.

12 Claims, 8 Drawing Sheets

(a)

(b)

IMAGE FORMING APPARATUS

FIELD OF THE INVENTION AND RELATED ART

The present invention relates to an image forming apparatus equipped with a changing apparatus of the magnetic brush type in accordance with the present invention.

The electrophotographic technologies which are presently widely used are as follows. First, an image bearing member is positively or negatively charged by a charging device. Then, a desired pattern is formed on the charged surface of the image bearing member by exposing the charged surface with an exposing means such as a laser scanner. More specifically, as a given point of the charged surface of the image bearing member is exposed, the electric charge of the given point is canceled by the electric charge generated in the electric charge generating layer of the image bearing member. Consequently, an electrostatic latent image is effected on the surface of the image bearing member. This electrostatic latent image is developed with frictionally charged toner, whereby an image is formed of the toner, in the pattern of the electrostatic latent image, on the surface of the image bearing member. The thus obtained image formed of the toner is transferred onto an image bearing final means such as a sheet of paper. Then, the image formed of toner is fixed to the image bearing final means by a heating means or the like. Then, the image bearing final means is discharged as a finished print from an image forming apparatus.

Primarily, there are three methods for charging a photosensitive member, in the field of electrophotography, which are: the method which uses corona; the method which uses a charge roller; and the method which injects electric charge.

The charging method of the corona type is such a charging method that uses a charging device having: a piece of metallic wire for discharge corona; and a metallic grid disposed in the adjacencies of a photosensitive member in a manner to oppose the peripheral surface of the photosensitive member. As DC current is applied to the wire, corona is discharged, generating ions. These ions move through the grid, and reach the surface of the photosensitive member, charging thereby the surface of the photosensitive member. The surface of the photosensitive member can be charged to a desired potential level by controlling the electric field between the grid and the surface of the photosensitive member, by applying voltage to the grid.

The charging method of the roller type is such a charging method that charges a photosensitive member by placing an electrically conductive rubber roller in contact with, or in the adjacencies of, the photosensitive member. As DC or AC voltage is applied to the metallic core of the rubber roller, electric discharge occurs between the surface of the photosensitive member and the peripheral surface of the roller, whereby the surface of the photosensitive member is charged. The surface of the photosensitive member can be charged to a desired potential level by controlling the DC voltage applied to the metallic core, or controlling the offset voltage of the AC voltage to be applied to the metallic core.

The charging method of the injection type is such a charging method that charges the surface of a photosensitive member by directly injecting electric charge into the photosensitive member by placing an electrically conductive member in contact with the surface of the photosensitive member and applying electric voltage to this member. As the member which is to be placed in contact with the surface of the photosensitive member, an electrically conductive roller, a fur brush roller, or the like, are employed in some cases. However, from the standpoint of better contact between the electrically conductive member and a photosensitive member, a magnetic brush is more prevalent than the abovementioned members. A magnetic brush is formed by magnetically confining electrically conductive magnetic particles on a magnet, or a sleeve which contains a magnet. In an operation for charging a photosensitive member, a magnetic brush is placed in contact with the surface of a photosensitive member, and electrical voltage is applied to the magnet or the sleeve, while the magnet or the sleeve is rotated. Thus, electric charge is injected into the photosensitive member. The potential level to which the surface of the photosensitive member is charged is roughly the same as the voltage level of the electrical voltage applied to the magnet or the sleeve.

The charging method of the corona type, and the charging method of the roller type, are such charging methods that primarily use electrical discharge. Therefore, this charging method generates byproducts with the progression of the charging operation. These byproducts of electrical discharge adhere to the surface of the photosensitive member. If hydrophilic byproducts of electrical discharge adhere to the surface of a photosensitive member in an environment which is high in humidity, the byproducts on the surface of the photosensitive member absorb the moisture in the air, making it easier for the electric charge on the surface of the photosensitive member to move. The movement of the electric charge on the surface of the photosensitive member results in the formation of an image which appears as if it is seen through a body of flowing water. Further, the electrical discharge sometimes generates substances which give out unpleasant odor. On the other hand, the charging method of the injection type is different from the charging methods of the other types in that it does not primarily use electrical discharge, and therefore, it does not have the undesirable side effects which the charging methods which primarily depend on electrical discharge have.

Further, the charging method of the corona type and the charging method of the roller type suffer from the problem that as the corona generating wire and charge roller become contaminated by toner or the like, the contaminated portions of the wire and roller, respectively, fail to properly charge the corresponding portions of a photosensitive member, which results in the formation of unsatisfactory images. On the other hand, the charging method of the magnetic brush type seldom suffers from this problem for the following reason. That is, the magnetic brush is larger than the corona generating wire and charge roller, in terms of the area of interaction between a charging member and a member to be charged, and therefore, is greater than the corona generating wire and charge roller, in terms of the frequency of the interaction between the charging member and the member to be charged. Thus, it is very seldom that a photosensitive member is unsatisfactorily charged by the charging method of the magnetic brush type.

One of the problems which the charging method of the magnetic brush type suffers is as follows. That is, during an image forming operation, the magnetic brush continuously rotates while remaining in contact with a photosensitive member, and therefore, it shaves away the surface layer of the photosensitive member. Since the surface layer of a photosensitive member is the portion of the photosensitive member, which actually holds the electric charge for drawing a latent image. Therefore, as the surface layer is lost by this shaving, the photosensitive member loses its function as an image bearing member. Thus, the speed at which the surface layer of a photosensitive member is shaved away is the dominant factor that determines the actual length of the service life of the photosensitive member.

The speed with which the surface layer of a photosensitive member is shaved away can be reduced by reducing the amount of magnetic particles on the surface of the magnetic particles (brush) bearing member, that is, by reducing the magnetic brush in thickness. However, this method makes less desirable the state of contact between the magnetic brush and the surface of the photosensitive member, reducing thereby the magnetic brush in charging performance. In order to ensure that a magnetic brush satisfactorily charges a photosensitive member, it has to be ensured that there is a satisfactory state of contact between the magnetic brush and the surface of the photosensitive member. Therefore, it is difficult to solve the above-described problem of the charging method of the magnetic brush type by simply reducing the amount of the magnetic brush forming magnetic particles by an amount large enough to significantly reduce the speed with which the surface layer of the photosensitive member is shaved away by the magnetic brush.

Further, there is an even greater problem than the above described one that the charging method of the magnetic brush suffers. This problem is that the speed with which the surface layer of a photosensitive member is shaved away by a magnetic brush is affected by the state (condition) of the magnetic particles in the magnetic brush. That is, when a charging device of the magnetic brush type is new, the speed with which the surface layer of a photosensitive member is shaved away by the magnetic brush of the charging device is relatively slow. However, with the increase in the number of the prints outputted by an image forming apparatus to which the charging device belongs, its magnetic particles sometimes change in condition, increasing therefore in the speed with which the magnetic brush they form shaves away the surface layer of the photosensitive member. Unless it is possible to predict the rate at which the speed with which the surface layer of a photosensitive member is shaved away by a magnetic brush, it is impossible to predict the remaining length of the service life of the photosensitive member, and therefore, the intervals with which the photosensitive member has to be replaced have to be unnecessarily reduced in length.

For example, in the case of an image forming apparatus structured as shown in FIG. 1, the external additive, such as silica, in toner is likely to slip by the cleaning blade, mix into the magnetic brush, and adhere to the surfaces of the magnetic particles. If the external additive adheres to the surfaces of the magnetic particles, it functions as an abrasive, increasing thereby the speed with which the surface layer of the photosensitive member is shaved away. Moreover, with the increase in the cumulative number of the prints with which the charging device was involved in their production, the magnetic particles in the charging device wear. As the magnetic particles wear, they change in surface properties, and their change in surface properties affects the speed with which the surface layer of the photosensitive member is shaved away by the magnetic brush they form.

As one of the methods for restoring in performance a charging device, the magnetic particles in which have changed in properties, it is effective to replace the magnetic particles having changed in properties, with brand-new magnetic particles as disclosed in Japanese Laid-open Patent Application 2001-042600.

Further, as a means for extending as much as possible the intervals with which a photosensitive member is to be replaced, it is effective to detect the changes in the state of the magnetic particle condition, estimate the speed with which the photosensitive member has been shaved away by the magnetic particles based on the value which shows the detected condition of the magnetic particles, and determine the timing with which the magnetic particles are to be replaced. Japanese Laid-open Patent Application H11-149194 states that there is a correlation between the pressure between magnetic particles and a magnetic particle regulating blade, and charging device performance, and between the pressure between the magnetic particle and the regulating blade and the speed with which the speed with which the surface layer of the photosensitive member is shaved away by the magnetic particles. It also discloses a method for controlling the frequency with which the magnetic particles in a charging device is to be replaced based on the information regarding the pressure. U.S. Pat. No. 7,103,303 discloses another method for supplying a charging device with fresh magnetic particles. According to this method, the magnetic particles in a charging device are measured in electrical resistance, and as the measured electrical resistance of the magnetic particles exceeds a preset value (standard), the charging device is supplied with fresh magnetic particles.

In the case of the method disclosed in Japanese Laid-open Patent Application 2001-42600 and the like, how abrasive the magnetic particles in a charging device are is not taken into consideration as one of the referential factors to be used to determine the timing with which the magnetic particles in the charging device are to be replaced. Therefore, it is possible that even when the magnetic particles in the charging device are still in the more or less desirable condition for image formation (even when speed with which surface layer of photosensitive member is shaved away is slower than preset range), the magnetic particles will be replaced. It is also possible that even when the magnetic particles in the charging device are not in the desirable condition for image formation (even when they are in such a condition as unexpectedly accelerates speed with which surface layer of photosensitive member is shaved away by them), the magnetic particles will not be replaced. In other words, it is possible that the magnetic particles will be replaced too often, or that the magnetic particles will not be satisfactorily replaced, and therefore, a photosensitive member will be drastically reduced in the length of its service life.

The method disclosed in Japanese Laid-open Patent Application H11-149194 suffered from the following problem. That is, there is sometimes a correlation between the pressure generated between the regulating blade and magnetic particles, and the speed with which the surface layer of a photosensitive member is shaved away by the magnetic particles. However, what is detected by the method disclosed in Japanese Laid-open Patent Application H11-149194 is the magnetic particle pressure on the downstream side of the regulating blade in terms of the rotational direction of a magnetic particle bearing sleeve. Therefore, it is difficult to estimate the speed with which the surface layer of a photosensitive member is shaved away by the magnetic particles, with the use of this method, because the speed is affected by both the surface condition of magnetic particles and the surface condition of a photosensitive member. That is, this method cannot fully control the speed with which the surface layer of a photosensitive member is shaved away by the magnetic particles.

The method disclosed in U.S. Pat. No. 7,103,303 suffered from the following problem. That is, there is a correlation between the electrical resistance value of a body of magnetic particles and the charging performance of the body of magnetic particles. However, it cannot be said that there is a strong correlation between the electric resistance value of a body of magnetic particles and the speed with which the surface layer of a photosensitive member is shaved away by the body of magnetic particles. The primary cause of the changes in the electric resistance of a body of magnetic particles is the adhesion of the resinous ingredients in the body of magnetic particles to the surfaces of the magnetic particles. On the other hand, the primary cause of the changes in the speed with which the surface layer of a photosensitive member is shaved away by the magnetic particles is the adhesion of external additive in a body of magnetic particles to the magnetic particles; the adhesion of the resinous ingredients to the magnetic particles has little effects upon the speed. Therefore, the performance of magnetic particles as the abrasives that shave away the surface layer of a photosensitive member cannot be estimated by measuring the electric resistance value of the magnetic particles. In other words, the speed with which the surface layer of a photosensitive member is shaved away cannot be controlled by measuring the electric resistance value of the magnetic particles.

SUMMARY OF THE INVENTION

It is an object of the present invention to provide an image forming apparatus wherein a shaving speed of a photosensitive layer is detected with precision, and the image forming operation is properly controlled.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Embodiment 1

Figure 1:
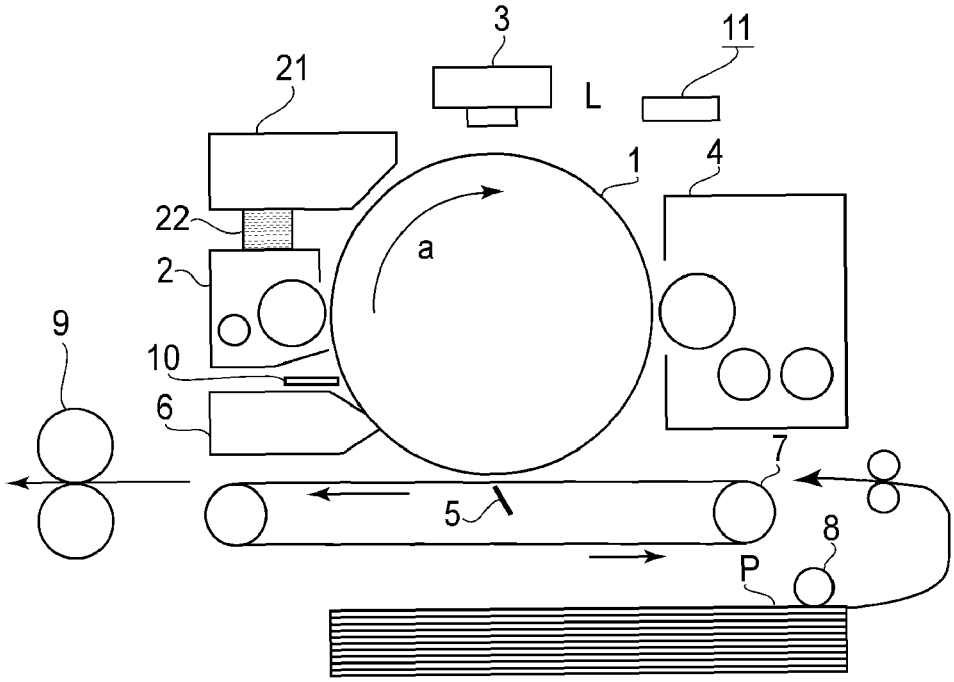
FIG. 1 is a schematic sectional view of an electrophotographic image forming apparatus in the first preferred embodiment of the present invention, and shows the general structure of the apparatus.

FIG. 1 is a schematic sectional view of an electrophotographic image forming apparatus, to which the present invention is applicable. It shows the general structure of the apparatus. The photosensitive drum 1 (image bearing member) used in the first embodiment of the present invention is a photosensitive member of the amorphous silicon type.

Referring to FIG. 1, the photosensitive member of the amorphous silicon type in this embodiment is made up of an electrically conductive supporting member formed of aluminum or the like, a charge injection preventing bottom layer, a photosensitive layer, a charge injection preventing upper layer, and a surface layer. All the layers were formed in layers on a piece of plain aluminum tube, with the use of a film forming method such as the plasma CVD or the like. The surface layer is roughly $10^{13}\Omega\cdot$cm in electrical resistance so that electrical charge can be injected into the photosensitive member. The surface layer is formed so that the light for forming a latent image is allowed to penetrate through the layer by a satisfactory amount. It is roughly 1.2 μm in thickness. The charge injection preventing upper layer is formed of a semiconductor of p-type. It is given the role of preventing negative electrical charge flowing into the electrically conductive supporting member after being injected into the surface layer. The photosensitive layer absorbs the light for latent image formation, whereby generating pairs of an electron and positive hole. The positive holes bear the role of forming a latent image. That is, they cancel the electrons in the charge injection by moving through the charge injection preventing upper layer formed of a semiconductor of p-type, whereas the electrons reach the electrically conductive supporting member by moving through the charge injection preventing bottom layer, which is of the n-type. The charge injection preventing bottom layer is the layer for preventing the positive holes from dispersing from the electrically conductive supporting member into the surface layer.

Figure 2:
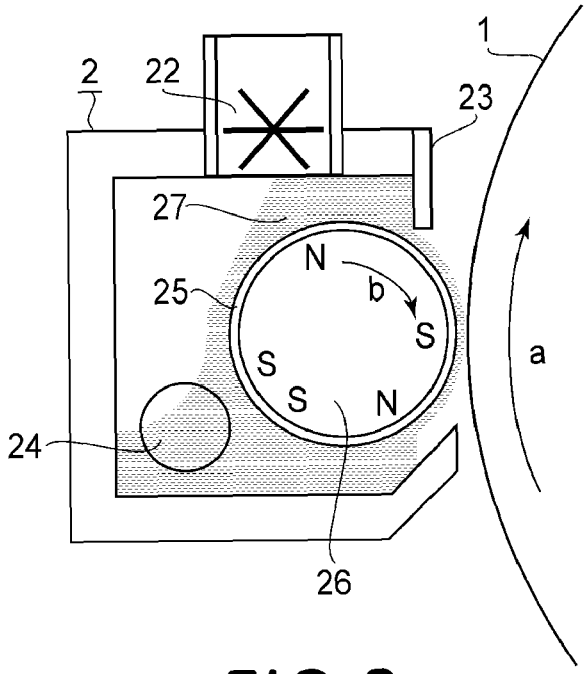
FIG. 2 is a schematic sectional view of the charging device of the magnetic brush type, which is used in the first embodiment of the present invention, and shows the structure of the charging device.

The charging device 2 of the magnetic brush type is structured as shown in FIG. 2. It is made of a container, a magnetic member 26, and a sleeve 25. The magnetic member 26 is immovably attached to the container. The sleeve 25 bears magnetic particles. It is made of a nonmagnetic substance (stainless steel, for example), and is 16 mm in external diameter. It is rotatably fitted around the magnetic member 26. The charging device 2 has also electrically conductive magnetic particles and a blade 23. The electrically conductive magnetic particles 27 are borne on the peripheral surface of the sleeve 25. The magnetic particles 27 on the sleeve 25 are made to crest in the form of a brush by the magnetic force of the magnetic member 26. The blade 23 is for evenly coating the magnetic particles on the peripheral surface of the sleeve 25 to a preset thickness. It is formed of nonmagnetic substance (stainless steel, for example). The electrical resistance of the electrically conductive magnetic particles are desired to be roughly in a range of $10^2\Omega\cdot$cm-$10^{10}\Omega\cdot$cm. The electrically conductive magnetic particles inject electric charge into the surface layer of the photosensitive drum by coming into contact with the surface layer. There are a magnetic particle storing portion 21 and a magnetic particle supplying apparatus 22 on the container. The magnetic particle storing portion 21 is for storing brand-new magnetic particles, that is, the magnetic particles which have not been contaminated with toner and/or external additives and have not been frictionally worn. The magnetic particle supplying apparatus 22 supplies the peripheral surface of the sleeve 25 with the magnetic particles in the magnetic particle storing portion 21. More specifically, the magnetic particles in the magnetic particle storing portion 21 are supplied by the magnetic particle supplying apparatus 22 to the magnetic particle enclave, which is in the top portion of the container (adjacency of bottom portion of magnetic particle supplying apparatus 23) and on the immediately upstream side of the magnetic particle regulating blade 23 in terms of the rotational direction of the sleeve 25. As the sleeve 25 is rotated, the magnetic particles on the sleeve 25 are conveyed by the sleeve 25 in the direction indicated by an arrow mark b. When the charging apparatus 2 is brand-new, its magnetic particle storing portion 21 has 500 g of brand-new magnetic particles. As a screw 24 for conveying magnetic particles is rotated, the magnetic particles are conveyed rearward in terms of the lengthwise direction of the screw 24, by a preset amount, and then, are recovered into a container for storing the recovered magnetic particles through a magnetic particle recovery opening (unshown), which is at the downstream end of the screw 24 in terms of the magnetic particle conveyance direction.

The sleeve 25 is rotated in such a direction that in the area in which the magnetic particles on the peripheral surface of the sleeve 25 come into contact with the peripheral surface of the photosensitive drum 1, the peripheral surface of the sleeve 25 moves in the opposite direction from the moving direction of the peripheral surface of the photosensitive drum 1. In this embodiment, the process speed (peripheral velocity) of the photosensitive drum 1 is 300 mm/sec, whereas that of the sleeve 25 is 360 mm/sec. An adjustment is made so that the area of contact (nip) between the magnetic particles on the sleeve 25 and the peripheral surface of the photosensitive drum 1 becomes roughly 6 mm wide in terms of the rotational direction of the sleeve 25 (drum 1). To the sleeve 25, a charge bias (which is combination of DC voltage and AC voltage) is applied from a charge bias power source (unshown). As the charge bias is applied to the sleeve 25, electric charge is injected into the surface layer of the photosensitive drum 1 from the magnetic particles 27 on the sleeve 25, whereby the surface layer of the photosensitive drum 1 becomes charged to a potential level which is close to the potential level of the charge bias. The charge bias applied in this embodiment was a combination of a DC voltage which is −600 V in magnitude, and an AC voltage which is 500 V in peak-to-peak voltage and 1,000 Hz in frequency.

The magnetic particles used in this embodiment were such ferrite particles that were adjusted in electrical resistance by being subjected to oxidization and reduction, and coated with silicon resin in which carbon black particles were dispersed for electrical resistance adjustment, and the amount of which was 1.0 wt. %. They were 25 μm in average particle diameter, 200 emu/cm$^3$ in saturation magnetization, and $5\times10^6\Omega\cdot$cm in electrical resistance. Incidentally, the method used for measuring the electrical resistance value of the magnetic particles is as follows: 2 g of the magnetic particles were placed in a metallic cell which was 227 mm$^2$ in bottom size. Then, the electrical resistance of the body of magnetic particles in the cell was measured while applying weight to the body of magnetic particles in the cell at a rate of 6.6 kg/cm$^2$ and also, applying 100 V of voltage between the two ends of the metallic cell.

The surface layer of the photosensitive drum 1 is evenly charged to −650 V by the charging device 2 of the magnetic brush type. Then, an exposing apparatus 3 scans (exposes) the charged portion of the peripheral surface of the photosensitive drum 1 with a beam of laser light L while modulating the beam with image formation signals, effecting thereby an electrostatic latent image on the photosensitive drum 1. This electrostatic latent image is reversely developed by a developing device 4. Consequently, an image is formed of toner on the photosensitive drum 1.

The developing method used in this embodiment is a developing method which uses two-component developer, that is, a mixture of negatively chargeable toner, and magnetic carrier. The toner is 6 μm in average particles diameter, and is made by pulverizing a hardened body of a mixture formed by dispersing pigments and wax in a resinous substance. The developer is made by adding external additives, such as titanium oxide and silica which are 20 nm and 100 nm, respectively, in average particles diameter to pure toner by roughly 1 wt. %. As the magnetic carrier, magnetic particles which are 205 emu/cm$^3$ in saturation magnetization and 35 μm in average particle diameter is used.

In synchronism with the timing with which the toner image formed on the photosensitive drum 1 arrives at the transfer nip between the photosensitive drum 1 and transfer belt 7, one of the sheets of recording medium P (which hereafter will be referred to simply as recording sheet P) in a recording medium feeding cassette is fed into the main assembly of the image forming apparatus, and is conveyed to a pair of registration rollers. Then, the recording sheet P is conveyed further to the transfer nip by the registration rollers. In the transfer nip, positive electric charge, which is opposite in polarity to the toner charge, is applied to the back side of a transfer blade 5, to which transfer bias is being applied. Consequently, the toner image on the photosensitive drum 1 is transferred onto the top side of the recording medium P. After the transfer of the toner image onto the recording sheet P, the transfer sheet P is conveyed further by the transfer belt 7 to a fixing apparatus 9. In the fixing apparatus 9, heat and pressure are applied to the recording sheet P and the toner image thereon, whereby the toner image is fixed to the surface of the recording sheet P. Then, the recording sheet P is outputted as a permanent print (copy) from the image forming apparatus.

As the toner image is transferred from the photosensitive drum 1 onto the recording sheet P, a small amount of toner (transfer residual toner) remains on the peripheral surface of the photosensitive drum 1. The transfer residual toner is scraped away by the cleaning blade of a cleaning apparatus 6, and recovered. Thereafter, the photosensitive drum 1 is exposed by the light from an LED array 10, being thereby reduced in potential to 0 V. Then, the photosensitive drum 1 is charged again by the charging device 2 of the magnetic brush type to be used again for image formation.

A CPU 1, which is a controlling means, controls the image forming operation of the image forming apparatus. In this embodiment, it controls the magnetic particle supplying apparatus 22 to cause the apparatus 22 to replace the magnetic particles in the charging device 2 of the magnetic brush type with a supply of fresh magnetic particles.

Next, the characteristic structural features of the charging device of the magnetic brush type in this embodiment will be described. In the case of the structure of the charging device of the magnetic brush type, disclosed in Japanese Laid-open Patent Application H11-149194, the magnetic particle pressure is detected on the downstream side of the magnetic particle regulating blade, in terms of the rotational direction of the sleeve. In other wards, in this case, only the condition of the magnetic particles on the downstream side of the magnetic particle regulating blade in terms of the direction of the sleeve rotation is observed.

It has become evident through the earnest studies made by the inventors of the present invention that the amount by which the photosensitive drum 1 is shaved away by the magnetic particles (magnetic brush) is affected by the change in the surface condition of the photosensitive drum 1 and the change in the surface condition of the magnetic particles, even if the magnetic particles on the downstream side of the regulating blade in terms of the direction of the sleeve rotation remain stable in condition. That is, even if the magnetic particles remain stable in condition, the speed with which the photosensitive drum 1 is shaved away by the magnetic particles is affected by the change in the surface condition of the photosensitive drum 1 and the change in the surface condition of the magnetic particles.

Figure 3:
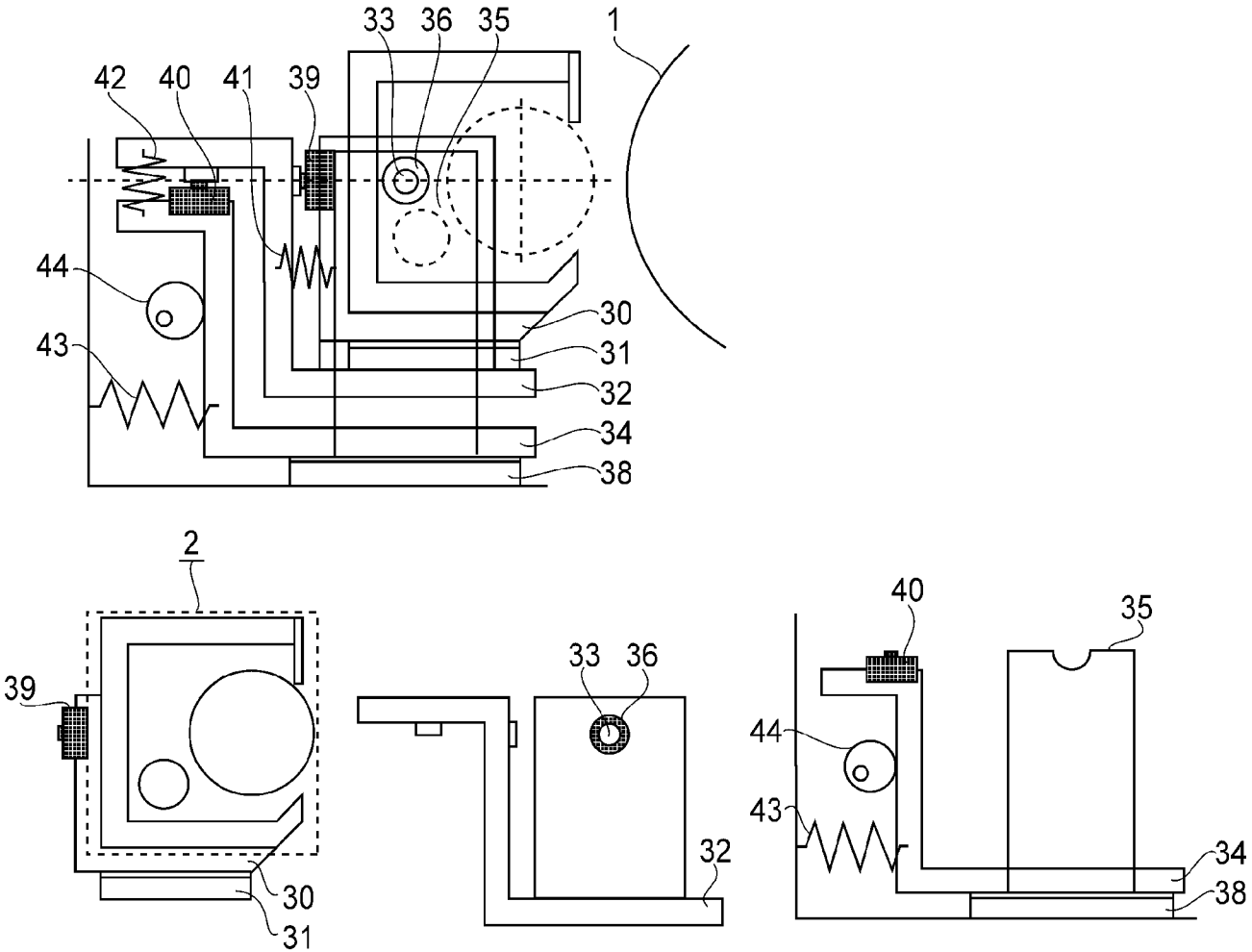
FIG. 3 is a schematic sectional view of the portion of the image forming apparatus in the first embodiment of the present invention, to which the charging device of the magnetic brush type is attached, and shows the structure of the portion.

In this embodiment, therefore, the speed with which the photosensitive drum 1 is shaved away by magnetic particles is calculated in consideration of the surface condition of the magnetic particles and the surface condition of the photosensitive drum 1, which can be determined by detecting the direction of the force generated in the area of contact between the photosensitive drum 1 and sleeve 25. FIG. 3 shows the structure of the portion of the main assembly of the image forming apparatus, to which the charging device 2 of the magnetic brush type is attached. The charging device of the magnetic brush type 2 is attached to the charging device holder 30, being thereby kept in proper attitude. The charging device holder 30 is solidly attached to a linear guide 31 attached to a rotational unit 32. There is a load cell X39 on the back side of the charging device holder 30. The load cell X39 is attached to the back surface of the charging device holder 30 in such a manner that it can measure the amount of the force which works in the direction (which hereafter will be referred to as SD normal line direction) parallel to the straight line which connects the center of the charging sleeve and the center of the photosensitive drum 1. Further, there is a tension spring X41, which is attached to the charge device holder 30 and rotational unit 32 so that it provides such a tensile force that is parallel to the SD normal line, between the charging device holder 30 and rotational unit 32. Thus, the charging device holder 30 is kept pulled by the resiliency of the tension spring X41 so that it slides toward the rotational unit 32. As the measuring portion of the load cell X39 is placed in contact with the rotational unit 32 by the sliding of the charging device holder 30 toward the rotational unit 32, the charging device holder 30 and rotational unit 30 are precisely positioned relative to each other.

In this embodiment, the load cell X39 is attached to the charging device holder X39. However, the load cell X39 may be attached to the rotational unit 32 so that the measuring portion of the load cell X39 comes into contact with the charging device holder 30. The portion with which the measuring portion of the load cell X39 is made to come into contact is desired to be formed of a substance which is unlikely to be deformed by the impact caused by the measuring portion of the load cell X39. Instead, the resiliency of the tension spring X41 may be set so that when the measuring portion of the load cell 39X comes into contact with a preset portion of the rotational unit 32, virtually no deformation occurs to the preset portion of the rotational unit 32.

The pair of lateral plates of the rotational unit 32 are provided with a pair of axles 33, one for one. The rotational unit 32 is attached to the slidable unit 34 in such a manner that its axles are supported by a pair of bearings 36 with which the slidable unit 34 is provided. To the slidable unit 34, a load cell Y40 is attached in such an attitude that it can measure the amount of force which works in the direction (which hereafter will be referred to as SD tangential line direction) which is perpendicular to the straight line which connects the center of the charging sleeve and the center of the photosensitive drum 1. Further, a tension spring Y42 is attached to the rotational unit 32 and slidable unit 34 so that the two units 32 and 34 are kept pulled toward each other in the direction parallel to the SD tangential line direction. That is, the rotational unit 32 is mounted so that it can be rotated about the pair of axles 33 by the resiliency of the tension spring Y42 in such a direction (counterclockwise direction) that the rotational unit 32 moves toward the slidable unit 34. Thus, as the rotational unit 32 is rotated, the measuring portion of the load cell Y40 on the slidable unit 34 comes into contact with the rotational unit 32, whereby the rotational unit 32 and slidable unit 34 are precisely positioned relative to each other. It possible to eliminate the tension spring Y42 by making such a structural arrangement that the center of gravity of the rotational unit 32 is positioned to cause the rotational unit 32 to be rotate about the axles 33 by its own weight. However, from the standpoint of ensuring that the measuring portion of the load cell Y40 and rotational unit 32 come into contact with each other, the structural arrangement which uses the tension spring Y42 is preferable.

The slidable unit 34 is mounted on a rail 38. There is an eccentric roller 44 on the rear side of the slidable unit 34. The eccentric roller 44 is independent from the slidable unit 34. Further, there is a tension spring Z43, which is attached to the slidable unit 34 and an immovable portion of the main assembly of the image forming apparatus so that the tensile force of the tension spring Z43 works in the direction parallel to the SD normal line direction. Thus, the slidable unit 34 is kept pressed by the resiliency of the tension spring Z43 in such a direction that the slidable unit 34 slides toward the eccentric roller 44, whereby it is made to come into contact with the eccentric roller 44. As the eccentric roller 44 is rotated, the distance between the rotational axis of the eccentric roller 44 and the point of contact between the eccentric roller 44 and slidable unit 34 changes.

In this embodiment, the design of the image forming apparatus is such that as the slidable unit 34 is slid by the rotation of the eccentric roller 44, the charging sleeve is moved in such a manner that its rotational axis remains on the straight line which connects the center of the photosensitive drum 1 and the center of the charging sleeve 25. The eccentric roller 44 is shaped so that as it is rotated, the charging sleeve 25 is moved between the point at which the distance between the photosensitive drum 1 and charging sleeve 25 is the smallest and the point at which the distance between the photosensitive drum 1 and charging sleeve 25 is sufficient for the magnetic brush not to contact the photosensitive drum 1.

The charging device 2 of the magnetic brush type is attached inside the main assembly of the image forming apparatus as described above. First, the eccentric roller 44 is rotated, while controlling the rotation, to increase the distance between the photosensitive drum 1 and charging sleeve 25 so that the magnetic brush does not contact the photosensitive drum 1. It is assumed that the amount of force measured by the load cell X39, and the amount of the force measured by the load cell X40, when the image forming apparatus is in the above described state are Fx(0) and Fy(0), respectively. These measurements are taken during the start-up of the image forming apparatus.

Next, the force generated between the charging sleeve 25 and photosensitive drum 1 is measured by the load cell X39 and load cell 40 while varying the amount of gap between the charging sleeve 25 and photosensitive drum 1 (which hereafter will be referred to as SD gap) by rotating the eccentric roller 44. In this embodiment, the eccentric roller 44 is the means for adjusting the dimension (width) of the SD gap in terms of the rotational direction of the photosensitive drum 1 (sleeve 25). More concretely, the SD gap is increased in 10 μm steps from a value which is 40 μm narrower than the desired preset value for the SD gap to a value which is 40 μm wider than the desired preset value for the SD gap. In other words, the data of Fx and Fy are obtained at a total of nine points. In this embodiment, the desired preset value for the SD gap is 300 μm.

The force generated between the charging roller 25 and photosensitive drum 1 is measured while rotating both the photosensitive drum 1 and charging sleeve 25. In order to minimize the amount of the measurement errors attributable to the fluctuation of the SD gap, which is attributable to the eccentricity of the charging sleeve 25, the force is measured for 10 seconds with 0.05 second intervals (sampling cycle of 0.05 second: total of 200 samplings), and the average values are used as the data. It is assumed that the data (values) obtained by the load cells X39 and Y40 are Fx(d) and Fy(d), respectively, and that Fx(d) and Fy(d) include the amount of the resiliency of the tension springs and the masses of the supporting members.

It is also assumed here that among the components of the force generated by the contact between the magnetic brush and photosensitive drum 1, the components measured by the load cell X39 and Y40 are Fx and Fy, respectively. Since Fx and Fy can be obtained by subtracting the values of the amount of the force measured when the magnetic brush is in contact with the photosensitive drum 1 from the values of the amount of the force when the magnetic brush and photosensitive drum 1 are not in contact with each other, the following mathematical equations hold.

$$Fx=Fx(d)-Fx(0)$$

$$Fy=Fy(d)-Fy(0)$$

Figure 4:
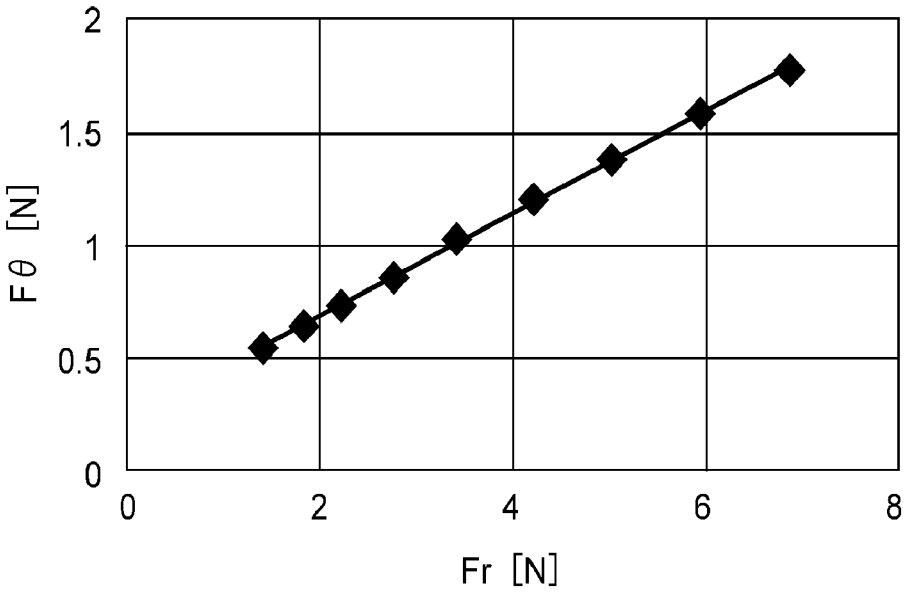
FIG. 4 is a graph which shows the relationship between Fr and Fθ of the force, in the first embodiment of the present invention.

It is assumed here that among the components of the force generated between the magnetic brush and photosensitive drum 1, the component which is parallel to the SD normal line and the component which is parallel to the SD tangential line are Fr and Fθ, respectively. The direction of the movement of the charging device supporting portion is regulated by the linear guide 31; it is only the direction parallel to the SD normal line that the charging device supporting portion can be moved. Therefore, the amount of Fr equals the amount of Fx. Further, the value of Fθ can be calculated using an equation related to the equilibrium of the moment of the rotational unit 32, where the distance from the rotational axis of the rotational unit 32 is the moment arm. As described above, the relationship between Fr and Fθ is calculated from the data of Fx and Fy obtained at nine points. FIG. 4 is a graph, the horizontal and vertical axes of which stand for Fr and Fθ, and in which the values of Fr and Fθ obtained by calculation are plotted. It is evident from FIG. 4 that the Fθ values can be approximated with the use of the following linear expression in which Fr is variable:

$$F\theta=\mu\cdot Fr+N$$

wherein μ stands for the coefficient (inclination) and N stands for the intercept. The values of μ and N can be obtained by calculation from the values of Fr and Fθ obtained by calculation from the data obtained by measuring values of the Fx and Fy at nine points, and obtaining a linear equation which shows the relationship between Fr and Fθ, using the least square method. In this embodiment, the image forming apparatus is designed so that the values of Fr and Fθ can be easily obtained by calculation from the values of Fx and Fy. As long as the direction of Fr is different from the direction of Fy, the values of Fr and Fθ can be obtained by calculating the amount of the component Fr and the amount of the component Fθ.

Figure 5:
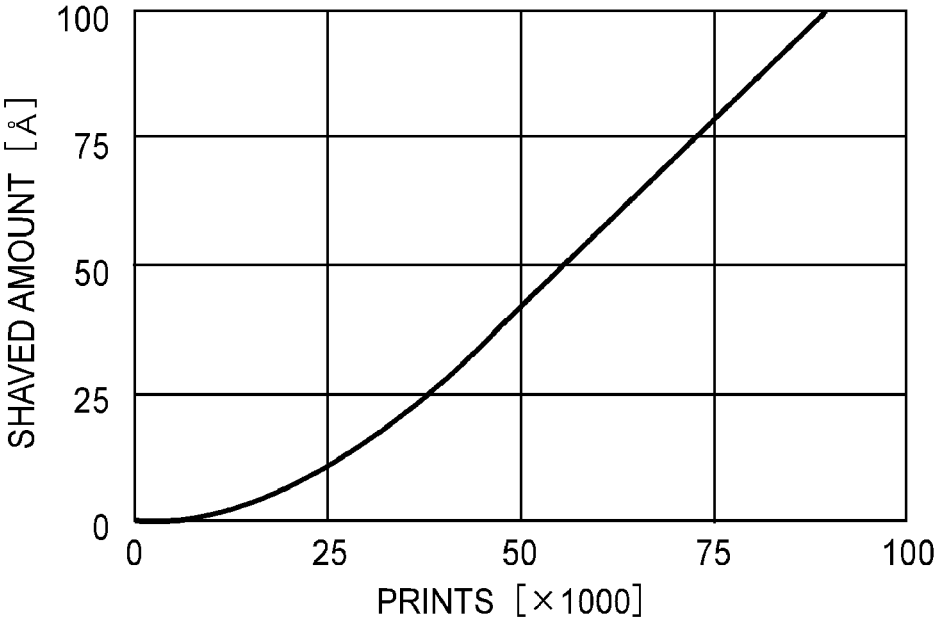
FIG. 5 is a graph which shows the relationship between the number of the prints outputted by the image forming apparatus in the first embodiment of the present invention and the amount by which the surface layer of the photosensitive member of the apparatus was shaved away.
Figure 6:
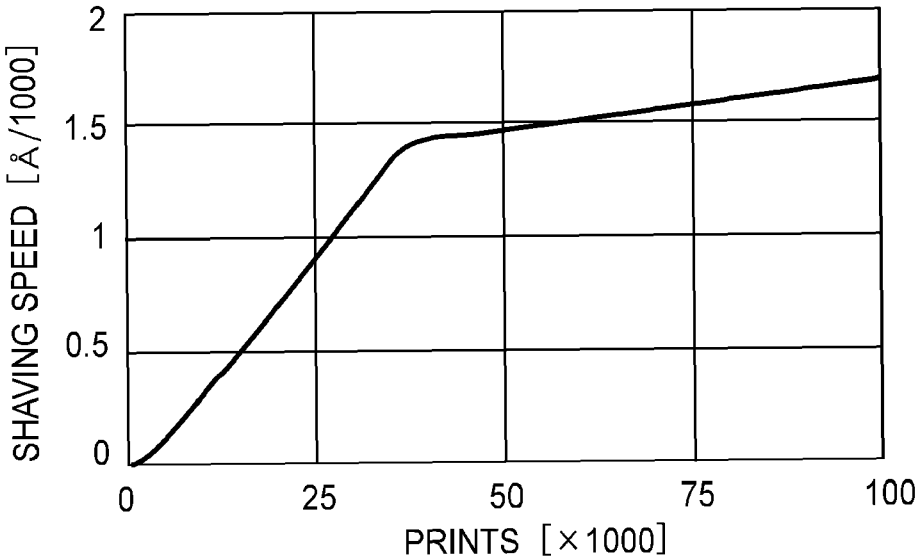
FIG. 6 is a graph which shows the relationship between the number of the prints outputted by the image forming apparatus in the first embodiment of the present invention and the speed with which the surface layer of the photosensitive member of the apparatus was shaved away.
Figure 7:
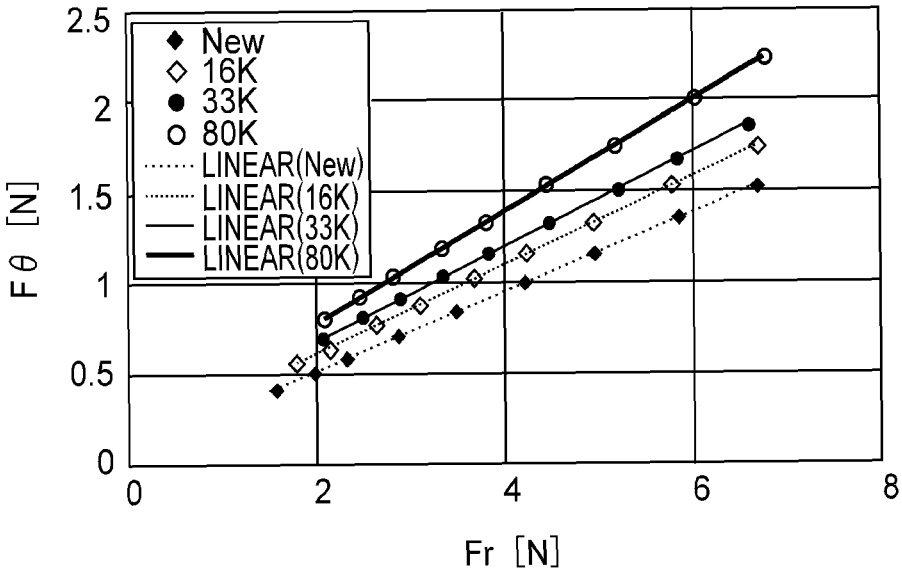
FIG. 7 is a graph which shows the changes in the relationship between the changes in Fr and Fθ, which occurred with the changes in the cumulated number of the prints outputted by image forming apparatus in the first embodiment of the present invention.
Figure 8:
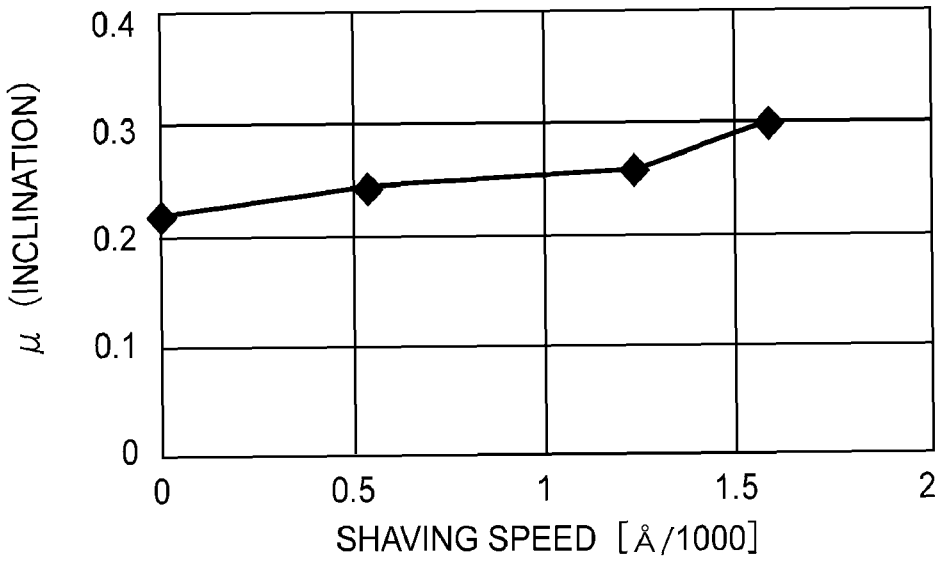
FIGS. 8(*a*) and 8(*b*) are graphs which show the relationship between the speed with which the surface layer of the photosensitive drum was shaved away and p, and the relationship between the speed with which the surface layer of the photosensitive member was shaved away and N, respectively.
Figure 8:
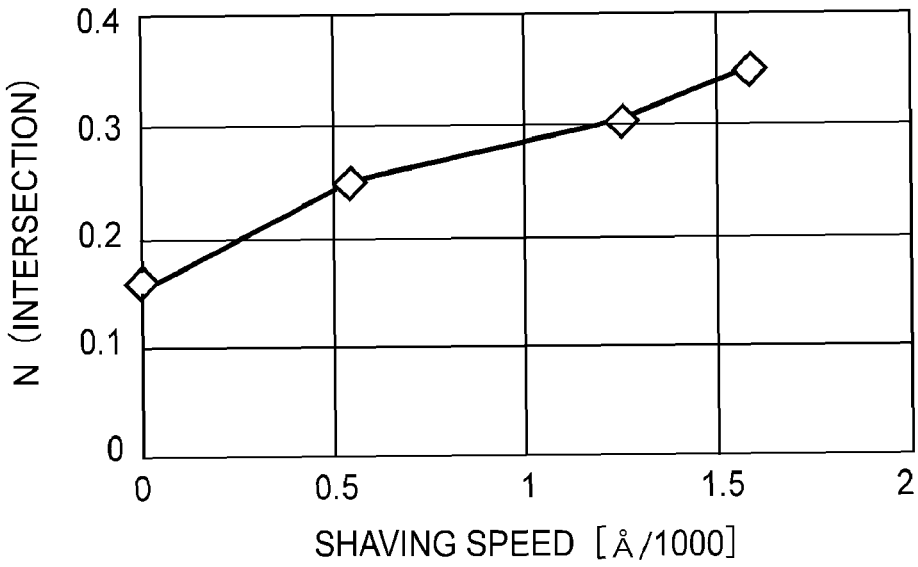

Experiments were done to determine how the amount by which the peripheral layer of the photosensitive drum 1 of an image forming apparatus is shaved away is affected by the cumulative number of the prints (copies) outputted by the image forming apparatus. The image forming apparatus was changed in printing ratio every 1,000th image, randomly in a range of 3%-20%. The results of the experiments are given in FIG. 5. FIG. 6 shows the relationship between the cumulative number of prints outputted by the apparatus, and the speed with which the surface layer of the photosensitive drum 1 was shaved away (amount by which surface layer of photosensitive drum 1 was shaved away per print (copy)), which were derived from the results of the experiments given in FIG. 5. FIG. 7 shows the relationship between the values of Fr and the values of Fθ, which were measured during the experiments in which the SD gap was changed when the cumulative number of the prints outputted by the apparatus was 16,000, 33,000, and 80,000. FIG. 8(*a*) shows the relationship between the speed with which the surface layer of the photosensitive member was shaved away, and μ (inclination), the values of which were calculated from the relationship between Fr and Fθ shown in FIG. 7. FIG. 8(*b*) shows the relationship between the speed with which the surface layer of the photosensitive drum 1 was shaved away and N (intercept), the values of which were obtained by calculation from the relationship between Fr and Fθ shown in FIG. 7.

It is evident from FIG. 6 that the speed with which the surface layer of the photosensitive member is shaved away increases with the increase in the cumulative number of the prints (copies) outputted. This phenomenon is attributable to the fact that as the magnetic particles gradually changes in surface condition, the state of contact between the photosensitive drum 1 and magnetic particles also gradually changes. It is evident from FIG. 7 that as the cumulative number of the prints (copies) outputted increases, the relationship between Fr and Fθ changes, causing thereby μ (inclination) and N (intercept) to increase in value. Further, it is evident from FIG. 8 that as the speed with which the surface layer of the photosensitive member is shaved increases, the calculated values of μ and N also increase.

It is evident that the values of μ and N increase with the increase in the cumulative number of the prints outputted by the image forming apparatus, and there is a correlation between the value of μ and the speed with which the surface layer of the photosensitive drum 1 is shaved away, and between the value of N and the speed with which the surface layer of the photosensitive drum 1 is shaved away. In the experiments in which the amount by which the surface layer of the photosensitive drum 1 is shaved away was measured in relation to the cumulative number of the prints outputted, the SD gap was kept unchanged during image formation, and the magnetic particles on the downstream side of the magnetic particle regulating blade in terms of the rotation direction of the sleeve 25 was kept roughly the same in their condition. That is, Fr, which was the force generated between the magnetic brush and photosensitive drum 1 in the direction parallel to the "SD normal line, was not changed during the image formation. Therefore, the values of μ and N may be treated as values which indicate the changes in the surface condition of the magnetic particles. The fact to which attention is to be paid here is that even if Fr does not change in value, the speed with which the surface layer of the photosensitive member is changed by the changes of μ and N in value. Therefore, it is obvious that it is impossible to determine the speed with which the surface layer of the photosensitive member is shaved away by observing the changes in the amount of pressure applied by the regulating blade, which is thought to affect Fr, as in Japanese Laid-open Patent Application H11-149194 described in the prior technology section. The speed with which the surface layer of the photosensitive member is shaved away can be reduced by the reduction in the values of μ and N. Further, μ and N can be reduced in value by replacing the magnetic particles which have been in use for a long time, with a supply of fresh magnetic particles.

During the period in which the image forming apparatus is started up, the values of Fx(0) and Fy(0) are measured while keeping the magnetic brush separated from the photosensitive drum 1. Then, an image forming operation is started. During the image forming operation, the SD gap is changed for every preset number of prints outputted, measuring thereby the values of Fx(0) and Fy(0) at nine points. Then, the values of Fr and Fθ are obtained by calculation from the information (measured values) of Fx(d) and Fy(d). Then, the values of μ and N are obtained by calculation from the values of Fr and Fθ, and are stored in the memory of the image forming apparatus. The image forming apparatus is programmed so that as the average of the values of μ stored in the memory exceeds a preset value μmax, the control portion of the image forming apparatus initiates the operation for replacing the magnetic particles in the charging device, and then, as the entirety of the magnetic particles in the charging device of the magnetic brush type 2 is replaced with a supply of fresh magnetic particles, the control portion puts the apparatus back in the image formation mode. Incidentally, the value for μmax is set in consideration of both the thickness of the surface layer of the photosensitive drum 1 and the size of the storage space for the replacement magnetic particles. In this embodiment, the value for μmax was set to 0.27.

Figure 9:
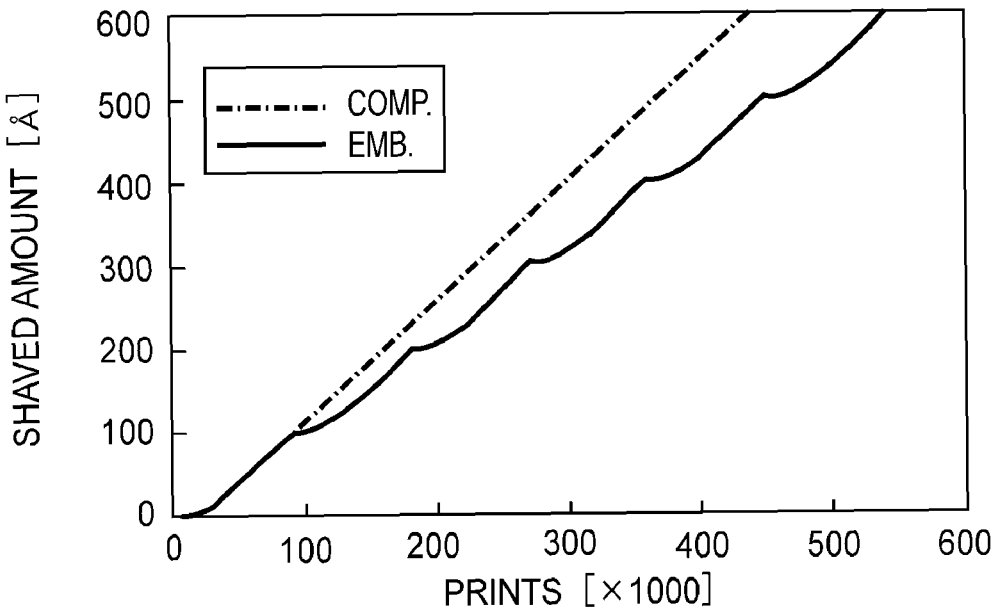
FIG. 9 is a graph which shows relationship between the cumulative number of prints outputted by the image forming apparatus in the first embodiment of the present invention, and the cumulative amount by which the surface layer of the photosensitive drum of the apparatus was shaved away.
Figure 10:
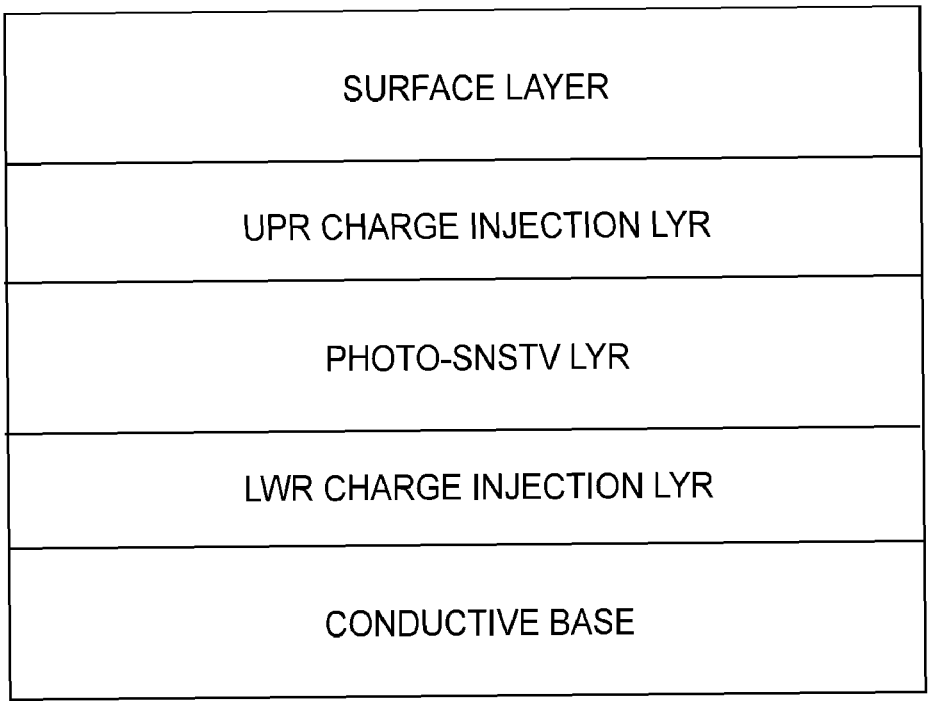
FIG. 10 is a schematic drawing of the photosensitive member in the first embodiment, which is formed of amorphous silicon, and shows the laminar structure of the photosensitive member.
Figure 11:
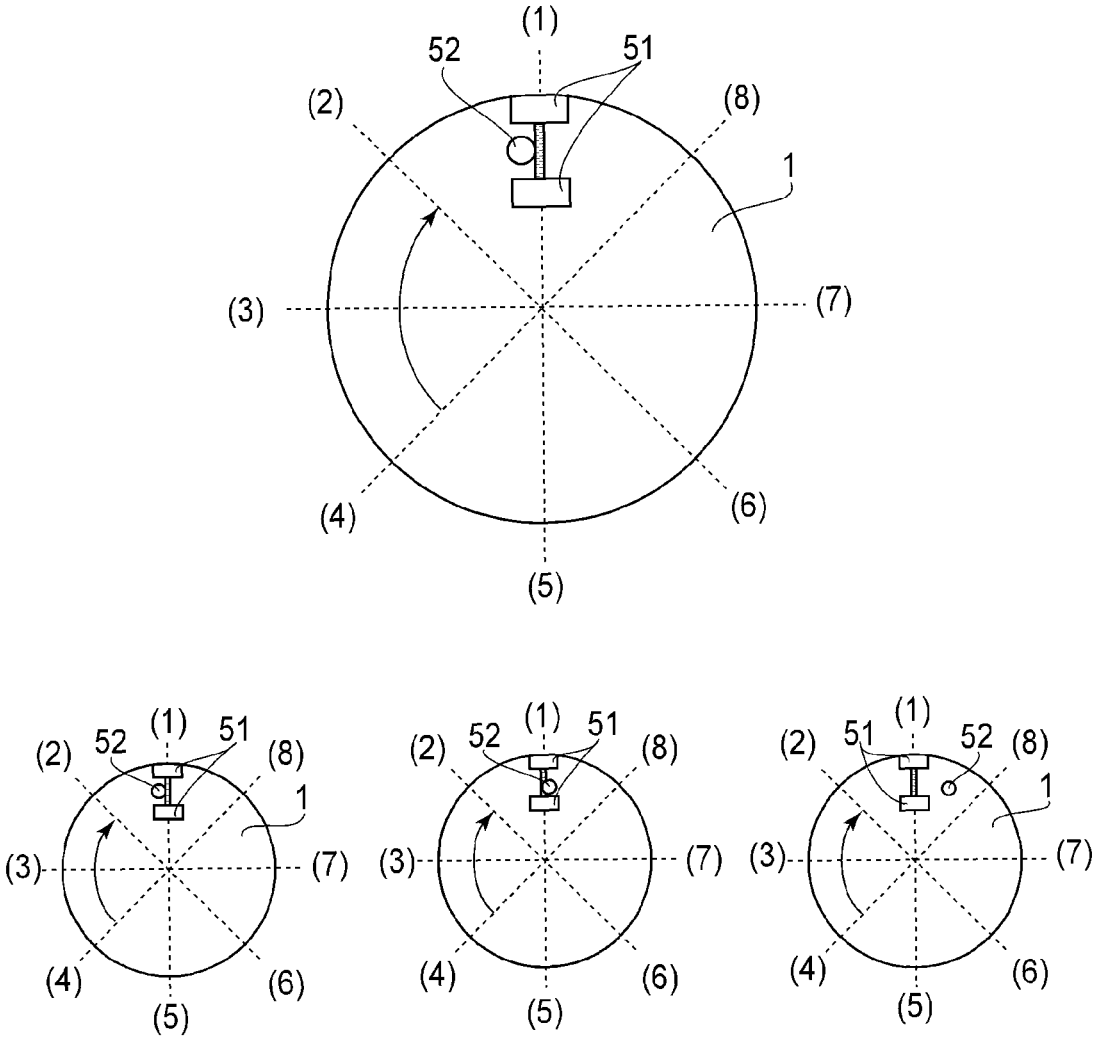
FIG. 11 is a schematic sectional view of the combination of the photosensitive drum and the means for detecting the rotational phase of the photosensitive drum, which were used in the second preferred embodiment of the present invention.

FIG. 9 shows the relationship between the cumulative number of prints outputted by an image forming apparatus and the speed with which the surface layer of the photosensitive member was shaved away when the magnetic particles in the charging device of the magnetic brush type 2 were not replaced at all, and that when the magnetic particles in the charging device of the magnetic brush type 2 were replaced by controlling the apparatus as described above. It is assumed that the durability, in terms of prints count, of the photosensitive drum 1 was 7,500,000 prints. The surface layer of the photosensitive drum of the comparative image forming apparatus 1 was completely shaved away before 7,500,000 prints were outputted, whereas the surface layer of the photosensitive drum 1 of the image forming apparatus in this embodiment lasted until 9,000,000 prints, which was far greater than the target count in terms of the durability of the photosensitive drum 1.

As described above, the speed with which the surface layer of the photosensitive member is shaved away is affected by the changes in the surface condition (mixing of external additives) of the magnetic particles. Further, the amount by which toner and external additive slip by the cleaner blade is affected by the changes in the image ratio (printing ratio). Thus, it is impossible to replace the magnetic particles in the charging device with proper timing by controlling the timing with which the magnetic particles are replaced, based on the cumulative number of the prints (copies) outputted by the apparatus. Thus, it is only by knowing the real time condition of the magnetic particles as in this embodiment that the magnetic particles in the charging device can be replaced with proper timing.

In this embodiment, the image forming apparatus was structured so that as the average value of μ, which is calculated for every 1,000 prints outputted by the apparatus, exceeds the value of μmax, the entirety of the magnetic particles in the charging device of the magnetic brush type is replaced. With this setup, it does not occur that the magnetic particles having changed in surface condition mix with fresh magnetic particles. Therefore, it is possible to reduce the speed with which the surface layer of the photosensitive member is shaved away, to the minimum value so that the photosensitive drum can be continuously kept satisfactory in performance for a substantially longer period of time.

On the other hand, μ can be reduced in value by replacing the magnetic particles in the charging device of the magnetic brush type even by a small amount, although the effects of the replacement is not as desirable as in the case where the entirety of the magnetic particles is replaced. However, replacing the magnetic particles by a small amount is advantageous in that the on-going image forming operation does not need to be interrupted to replace the magnetic particles. Therefore, it is an effective means for making it possible to keep the photosensitive drum 1 satisfactory in performance for a substantially longer period of time, without sacrificing productivity.

In this embodiment, the values of the Fr and Fθ were measured at nine points while varying the SD gap, and the values of μ and N were calculated from the measured values of the Fr and Fθ. However, as long as the values of Fr and Fθ can be measured at no less than two points, the values of μ and N can be calculated.

Also in this embodiment, μ, the values of which were calculated based on the relationship between Fr and Fθ, was used as the parameter for determining the timing with which the magnetic particles are to be replaced. However, N, the values of which are calculated along with the values of μ, may be used as the parameter for determining the timing with which magnetic particles are to be replaced.

During the period in which the image forming apparatus is started up, the values of Fx(0) and Fy(0) are measured while keeping the magnetic brush separated from the photosensitive drum 1. Then, an image forming operation is started. During the image forming operation, for every preset cumulative number (1,000 in this embodiment) of prints outputted by the apparatus, the values of Fx(0) and Fy(0) are measured; the values of Fr and Fθ were calculated; and the values of μ and N are calculated, and stored in the memory of the image forming apparatus. The image forming apparatus is set up so that as the average of the values of N stored in the memory exceeds a preset value Nmax, the control portion of the apparatus initiates the operation for replacing the magnetic particles in the charging device, replacing thereby the entirety of the magnetic particles in the charging device 2 of the magnetic brush type with a supply of fresh magnetic particles, and then, the control portion puts the apparatus in the image formation mode. Incidentally, the value for Nmax is set in consideration of both the thickness of the surface layer of the photosensitive drum 1 and the size of the storage space for the replacement magnetic particles.

As described above, even in the case where N was used as the parameter for controlling the timing for magnetic particle replacement, the obtained results were virtually the same as those obtained when μ was used as the parameter for controlling the magnetic particle replacement timing.

As described above, in this embodiment, in order to control the operation for replacing the magnetic particles in the charging device of the magnetic brush type, the two components (Fr (first force), and Fθ (second force)) of the force generated between the magnetic brush and photosensitive drum are measured. More specifically, multiple sets of values of Fr and Fθ are obtained by measuring Fr and Fθ in value under various conditions. Here, "various conditions" means conditions different in the SD gap, which is changeable by the eccentric roller 44. The magnetic particles in the charging device are replaced based on μ (inclination) or N (intercept) of the linear equation approximated by plotting the multiple sets of values of Fr and Fθ on a graph, one axis of which stands for Fr, and the other axis of which stands for Fθ. In other words, μ and N, the values of which are calculable from the relationship between Fr and Fθ, as described above, and indicate the extent of the changes in the surface properties of the magnetic particles, are used as the parameters for initiating the magnetic particle replacement operation. The usage of μ or N as the parameter for determining the length of the interval with which the magnetic particles in the charging device is to be replaced makes it possible to accurately estimate the speed with which the surface layer of the photosensitive member is shaved away, and therefore, to replace the magnetic particles with a proper timing. In other words, this embodiment of the present invention can significantly extend the intervals with which the photosensitive member is replaced.

Incidentally, in this embodiment, as the parameter for determining the timing with the magnetic particles in the charging device is to be replaced, attention was paid to only μ and N. However, the magnetic particles may be replaced in consideration other factors than μ and N, which also affect the speed with which the surface layer of the photosensitive member is shaved away, in addition to a and N. For example, the magnetic particles may be replaced in consideration of the regulating blade pressure, such as the one disclosed in one of the aforementioned laid-open patent applications, in addition to μ and N.

Embodiment 2

The image forming apparatus used in this embodiment is the same as the one shown in FIG. 1, which was used in the first embodiment. Therefore, its general structure will not be described. This embodiment shows that the data regarding Fr and Fθ can be obtained without controlling the SD gap as it was in the first embodiment.

Usually, ordinary image forming apparatuses such as the one shown in FIG. 1 suffer from component size errors, geometrical errors, assembly errors, etc., and also, the aggregation of these errors. Thus, their photosensitive members, sleeves, rollers, etc., are likely to eccentrically rotate, being therefore not uniform in the distance between their rotational axes and peripheral surfaces. With the photosensitive drum and sleeve eccentrically rotating, the SD gap varies. It is assumed in this embodiment that the range in which the SD gap is varied by the rotation of the photosensitive drum 1 is 20 μm, whereas the range in which the SD gap is varied by the rotation of the charging sleeve 25 is 15 μm.

In the first embodiment, the values of Fr and Fθ were measured at nine different points in total while controlling the SD gap, that is, expanding the SD gap from the value which is 40 μm smaller than the desirable SD gap to the value which is 40 μm greater than the desirable SD gap, in 10 μm steps. Referring to FIG. 4, which shows the results of the above-mentioned measurements in the first embodiment, the values of μ and N, which calculated based on the straight line between the adjacent to points plotted based on the data of Fr and Fθ are virtually the same as the values of the μ and N, which are calculated using the linear equation obtained by approximation from the data of Fr and Fθ obtained at nine points. The difference in data between the adjacent two points at which the values of Fr and Fθ were measured is attributable to the difference of 10 μm in the average value of the SD gap between the two points. Therefore, as long as data (values of Fr and Fθ) can be obtained at adjacent two points which are different in the value of Fr, the values of μ and N can be obtained by calculation without changing the SD gap as much as it was changed in the first embodiment.

As the primary factors which affect Fr in value, there are the fluctuation in the amount by which magnetic particles are allowed to be borne on the sleeve 25 per unit area of the peripheral surface of the sleeve 25 by the magnetic particle amount regulating blade, and the fluctuation of the SD gap, which is attributable to the eccentricity of the photosensitive drum 1 and/or charging sleeve 25. The reason why the SD gap was controlled in the first embodiment is that the wider the range in which Fr is varied in value, the more precisely the values of μ and N can be obtained by calculation.

As the gap between the charging sleeve and regulating blade (which hereafter will be referred to as SB gap) reduces due to the eccentricity of the charging sleeve, the amount by which magnetic particles are borne on the charging sleeve per unit area of the peripheral surface of the charging sleeve also reduces. In a case where the gap between the point of the peripheral surface of the charging sleeve, which makes the SB gap smallest, and the peripheral surface of the photosensitive drum 1, is smallest, the fluctuation of the SD gap, which is attributable to the eccentricity of the charging sleeve virtually coincide with the fluctuation of the SB gap, and therefore, the SD gap reduces. That is, when the amount of the magnetic particles on the charging sleeve is small, the SD gap is small, whereas when it is large, the SD gap is wide.

The smaller the SB gap, the smaller the amount by which the magnetic particles are borne by the charging sleeve, and therefore, the smaller the value of Fr. Further, the smaller the SD gap, the more compacted the magnetic particles become in the magnetic particle passage (between charge roller and photosensitive drum), and therefore, the greater the value of Fr. As described above, if it is taken into consideration that as the SB gap reduces due to the eccentricity of the charging sleeve, the SD gap also reduce, it is evident that as the SB gap reduces due to the eccentricity of the charging sleeve, the fluctuation of the value of Fr, which is attributable to the eccentricity of the charging sleeve, reduces. Therefore, the fluctuation of the SD gap, which is attributable to the eccentricity of the photosensitive drum 1 is most dominant as the cause of the fluctuation of Fr value. In this embodiment, the rotational phase of the photosensitive drum 1 is detected, and the values obtained by measuring the force at the same rotational phase of the photosensitive drum 1 are averaged. If the effect of the eccentricity of the charging sleeve is large, the values obtained by measuring the force at the same rotational phase of the photosensitive drum 1, are different, and therefore, it is possible that the average value is not accurate. However, because the charging apparatus of the magnetic brush type in this embodiment is structured as described above, it is small in such errors as those described above.

Referring to FIG. 1, the image forming apparatus in this embodiment is provided with a phase detecting device 51 for detecting the rotational phase of the photosensitive drum 1. As a rotational block member 52, which rotates about the rotational axis of the photosensitive drum 1, blocks the light path of the phase detecting device 51, the output from the phase detecting device 51 is interrupted.

The relationship which occurs between the rotational phase of the photosensitive drum 1 and the values of Fr and Fθ during every full rotation of the photosensitive drum 1 can be accurately controlled by dividing the values continuously obtained the load cells, into a preset number of sets, by the frequency with which the light path of the phase detecting device 5 by the blocking member 5.

Figure 12:
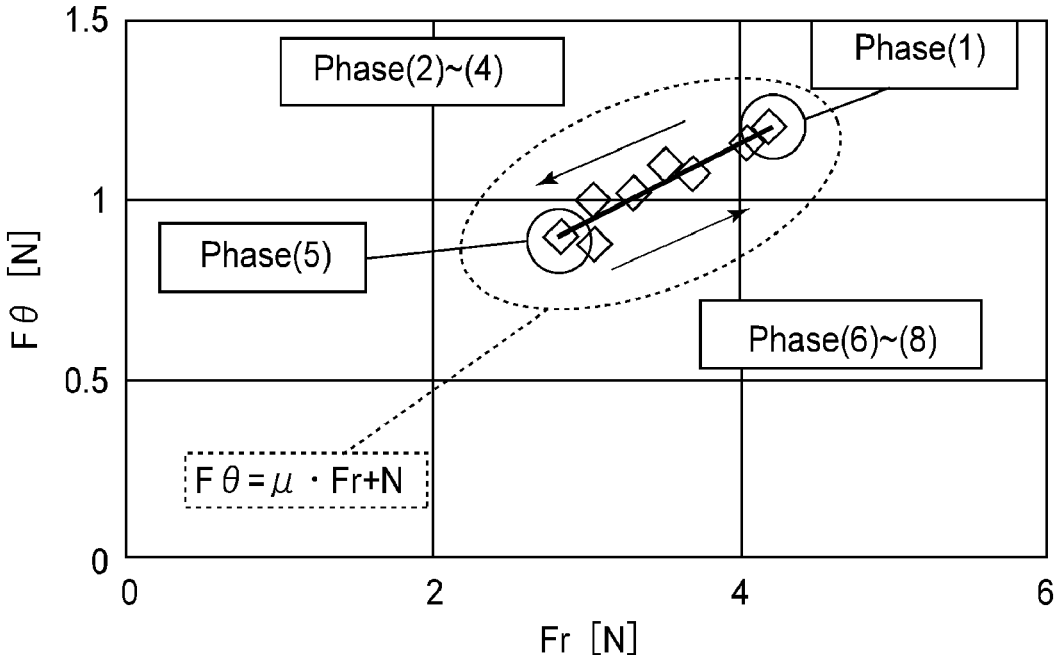
FIG. 12 is a graph which shows the relationship between Fr and Fθ in the second embodiment of the present invention.

The rotational phase of the photosensitive drum 1, and the force generated between the magnetic brush and photosensitive drum 1, are measured at the same time while rotating the photosensitive drum 1 20 times. Then, the averages obtained by dividing the measured values of the force by 20, were used as the values of the Fr and Fθ per full rotation of the photosensitive drum 1. That is, Fr values and Fθ values were measured multiple times at the same rotational phase of the photosensitive drum 1, and average of Fr values and the average of the Fθ values were obtained for each rotational phase. The length of time it takes for the photosensitive drum to rotate one full turn was divided by eight, and the relationship between Fr and Fθ in each of the eight sections of the length of time it takes for the photosensitive drum 1 to rotate one full turn is shown in FIG. 12. The linear equation obtained by approximation from the measured values of the force, plotted in FIG. 12, is similar to the linear equation obtained by approximation from the measured values of the force, plotted in FIG. 4.

In this embodiment, the values obtained by averaging the Fr values and Fθ values measured while rotating the photosensitive drum 1 20 times was used as the Fr value and Fθ value, respectively. However, the greater the number of the points of measurement, the more accurately the Fr value and Fθ value can be calculated.

In this embodiment, in order to measure the amount of the force as accurately as possible, a means for detecting the rotational phase of the photosensitive drum 1 was provided. However, the average value obtained by dividing the data obtained by measuring the force, by the number of times the photosensitive drum 1 was rotated, may be used as the measured value.

Also in this embodiment, a control similar to that in the first embodiment was executed. The obtained results also were similar to those in the first embodiment.

In this embodiment, in order to makes different the condition under which the Fr values are measured, from the condition under which the Fθ values are measured, the rotation phase of the photosensitive drum 1 at which the Fr values are measured is made different from the rotational phase at which the Fθ values are measured. Thus, it is unnecessary to vary the SD gap with the use of an eccentric roller, such as the roller 44 used in the first embodiment, when the image forming apparatus is in the mode for measuring the Fr values and Fθ values. Therefore, the time for executing the special control operation for obtaining the data is unnecessary. In other words, this embodiment can reduce an image forming apparatus in downtime. Further, in this embodiment, it is unnecessary to vary the state of contact between the photosensitive drum 1 and magnetic brush while measuring the Fr values and Fθ values. Therefore, prints (copies) can be reliably outputted even while taking the measurements.

Embodiment 3

The image forming apparatus used in this embodiment is the same as the one shown in FIG. 1, which was used in the first embodiment. Therefore, the overall structure of the apparatus will not be described here. In this embodiment, the timing with which the entirety of the magnetic particles in the charging device container is to be replaced is not determined based on the value of μ or N as in the first and second embodiments. Instead, the charging device is supplied with fresh magnetic particles with preset intervals while the amount by which the fresh magnetic is supplied is controlled, based on the value of μ or N.

Referring to FIG. 7, with the increase in the cumulative number of the prints outputted by the image forming apparatus, μ and N, which indicate the surface condition of the magnetic particles also increase in value. Next referring to FIG. 8, with the increase in the values of μ and N, the speed with which the surface layer of the photosensitive member is shaved away increases. Based on these facts (phenomena), it is evident that the speed with which the surface layer of the photosensitive member is shaved away can be kept under a preset value by keeping the values of μ and N smaller than preset values.

One of the methods for keeping the value of μ and the value of N below preset ones, respectively, is to replace the entirety of the magnetic particles in the charging device container as it was in the first and second embodiments. However, μ and N can be controlled in value also by replacing the magnetic particles in the charging device container with fresh magnetic particles by the amount less than the entire amount of the magnetic particles in the charging device container, with preset intervals (for every 1000 prints outputted).

Assuming that the rate at which the charging device is supplied with magnetic particles is one gram per 1,000 prints, one of the ordinary methods thinkable as the method for supplying a charging device of the magnetic brush type with magnetic particles is to supply the charging device with magnetic particles by 0.1 g per 100 prints, by 1.0 g per 1,000 prints, etc. A method which is higher in the frequency with which the charging device is supplied with magnetic particles can keep smaller the amount of the change in the surface condition of the magnetic particles than a method which is lower in the frequency. However, the former is smaller in the amount by which the charging device is supplied with magnetic particles per magnetic particle supplying operation than the latter. Therefore, it requires that the amount by which the charging device is supplied with magnetic particles is more precisely controlled than the latter. In the case of the latter method, it is unnecessary to control the amount by which magnetic particles are supplied, as precisely as in the case of the former method. However, it is possible that the magnetic particles in the charging device will change more in surface properties. In other words, in the case of the latter method, it is possible that the magnetic particles having greatly changed in surface properties will be continuously used for a long time, and therefore, a photosensitive drum will be greatly reduced in the length of its service life.

Further, in a case where the magnetic particles in the charging device are replaced by a preset amount with preset intervals as in the above described case, it is possible that even when it is estimated that the speed with which the surface layer of the photosensitive member is shaved away will be substantially slower than the values in the permissible speed range, the charging device will be supplied with fresh magnetic particles. In other words, it is possible that a preset amount of the magnetic particles in the charging device will be replaced even though they are still in the satisfactory condition, or that even after the magnetic particles in the charging device deteriorated in surface condition so much that the speed at which they shave away the surface layer of a photosensitive drum is shaved away exceeds the values in the permissible range, the speed with which the surface layer of the photosensitive member is shaved away will not be prevented from increasing, because the amount by which the magnetic particles in the charging device is replaced is insufficient.

Thus, such a method is effective that the magnetic particles in the charging device is replaced with preset intervals, and the amount by which the magnetic particles are replaced is determined based on the results of the monitoring of the changes in the surface condition of the magnetic particles.

This embodiment shows the method in which the magnetic particles in the charging device are replaced with preset intervals, by the amount determined based on the amount and rate of the changes in value of μ or N.

The method, in this embodiment, for obtaining the values of μ and N by calculation is similar to that in the first embodiment, and therefore, will not be described here. The values of μ and N are obtained by calculation for every 1,000 prints outputted by the image forming apparatus, and are stored in the memory of the apparatus.

As the μ value obtained by calculation exceeds a preset μmax, the image forming apparatus is put in a mode in which the magnetic particles in the charging device container are replaced by 1 g. Then, the value of μ is obtained again by calculation as soon as 1,000 prints are outputted after the replacement of the magnetic particles. If the μ value is no less than μmax, and is smaller than the μ value immediately before the magnetic particle replacement, this means that μ was successfully reduced in value by the preceding replacement of the magnetic particles by 1 g, and therefore, it is unnecessary to adjust the amount by which the magnetic particles in the charging device is replaced. Thus, the magnetic particles in the charging device are replaced by 1 g, also this time. On the other hand, if μ has increased in value compared to its value immediately before the replacement of the magnetic particles, the amount by which the magnetic particles in the charging device is replaced is increased to 2 g. That is, as long as μ keeps on increasing in value, the amount by which the magnetic particles is replaced is increased until μ begins to decrease in value. If the value of μ is no more than the μmax, the magnetic particles in the charging device are not replaced. Then, as the value of μ becomes greater than the μmax because of the following outputting of prints, the magnetic particles in the charging device is replaced by 1 g.

As described above, this embodiment can stabilize μ in value so that its value remains in the adjacencies of the μmax, by controlling the amount by which the magnetic particles in the charging device is replaced, in response to the changes in the numerical value of μ, which indicates the surface condition of the magnetic particles. Therefore, it can prevent the speed with which the surface layer of the photosensitive member is shaved away from becoming higher than the permissible one. Therefore, it can extends the photosensitive drum replacement intervals.

In this embodiment, the value of μ, and the rate of the change in the value of μ, were used as the parameters used for controlling the amount by which the amount by which the magnetic particles in the charging device are increased or decreased. However, the value of N, and the rate with which N changes in value, may be used as the parameter for controlling the amount by which the amount by which the magnetic particles in the charging device are replaced, is to be modified. The results of the usage of N will be the same as those of the usage of μ.

Embodiment 4

The image forming apparatus used in this embodiment is the same as the one shown in FIG. 1, which was used in the first embodiment. Therefore, the overall structure of the apparatus will not be described here. In this embodiment, a means for keeping below a preset value the amount by which the magnetic particles in the charging device container are consumed for outputting a preset number of prints, and also, for extending the photosensitive drum in the length of its replacement intervals.

As an image forming apparatus is increased in printing ratio, more external additive, such as silica, slips by the cleaner blade, and therefore, the magnetic brush increases in the amount of the external additive therein, which in turn greatly changes the magnetic particles in the magnetic brush in surface condition. As the magnetic particles in the magnetic brush greatly change in surface condition, the speed with which the surface layer of the photosensitive member is shaved away greatly increases. As a means for reducing the speed with which the surface layer of the photosensitive member is shaved away, it was effective to replace the magnetic particles in the charging device container. However, when the image forming apparatus is high in printing ratio, the frequency with which the magnetic particles in the charging device is replaced is also high, and therefore, the amount by which the magnetic particles are consumed for outputting a preset number of prints is high, which in turn increases the cost for outputting a preset number of prints. Thus, in order to prevent the cost increase, the amount by which magnetic particles are used for outputting a preset number of prints has to be kept below a preset value.

Also in this embodiment, the values of μ and N are obtained by calculation using the same methods as those used in the first to third embodiments. They are obtained for every 1,000 prints outputted by the image forming apparatus, and stored in the memory of the apparatus. It is assumed here that the amount by which a changed in value between before and after the outputting of the 1,000th print is Δμ. If Δμ is large in value, this means that the speed with which the surface layer of the photosensitive member is shaved away was increasing very fast. In order to keep below a preset value the amount by which the magnetic particles in the charging device is used per a preset number of prints outputted by the apparatus, Δμ has to be reduced in value.

In the first to third embodiments, the intervals with which the photosensitive drum is to be replaced was extended by measuring the force generated between the magnetic brush and the surface layer of the photosensitive drum, in its magnitude in terms of two different directions; determining the amount of the changes in the surface condition of the magnetic particles in the charging device from the measured values of the force, and then, replacing the magnetic particles in the charging device based on the determined surface condition of the magnetic particles. However, the speed with which the surface layer of the photosensitive member is shaved away can be reduced also by reducing the AC voltage applied to the charging sleeve.

The charging method of the charge injection type can charge the surface layer of a photosensitive drum to a potential level which is roughly the same as that of the DC voltage applied to the charging sleeve, even if the voltage applied to the charging sleeve is only DC voltage. However, for the following reason, it is difficult to charge the surface layer of a photosensitive drum to a desired potential level by applying DC voltage alone.

The magnetic particles is lower in electrical resistance when the particles are in a strong electric field than when they are in a weak electric field. Immediately after a given portion of the surface layer of a photosensitive drum enters the contact nip between the photosensitive drum and the magnetic brush formed of magnetic particles, the difference in potential level between this portion of the photosensitive drum and the peripheral surface of a charging sleeve is large, and therefore, the resultant electric field is strong. Therefore, the magnetic particles remain relative low in electric resistance, and therefore, electric charge is relatively rapidly injected from the charging sleeve into the surface layer of the photosensitive drum. As electric charge is injected into the photosensitive drum, the surface layer of the photosensitive drum becomes higher in potential level, while the DC voltage applied to the charging sleeve does not change in value. Consequently, the different in potential level between the charging sleeve and photosensitive drum reduces, which in turn reduces the electric field in strength. As the electric field reduces in strength, the magnetic particles increase in electric resistance, which in turn reduces the speed with which electric charge is injected from the charging sleeve into the photosensitive drum, making sometimes it impossible for the given point of the surface layer of the photosensitive drum to be charged to a desired potential level while the given point is moved through the nip.

As the means for ensuring that the potential of a given point of the surface layer of the photosensitive drum converges to a desired level while the given point is moved through the nip between the magnetic brush and photosensitive drum, it is effective to apply AC voltage, in addition to DC voltage, to the charging sleeve. Even though the potential of the surface layer of the photosensitive drum is converged to the desired level by the application of the AC voltage, the length of time the difference in potential level between the charging sleeve and surface layer of the photosensitive drum grows is increased by the application of the AC voltage. Therefore, it is possible to increase the speed with which electric charge is injected from the charging sleeve into the photosensitive drum by keeping low the electric resistance of the magnetic particles.

The higher the value of the AC voltage applied to the charging sleeve, the greater the difference in potential level between the charging sleeve and surface layer of the photosensitive drum, and therefore, the shorter the length of time it takes for the charging device to charge the surface layer of the photosensitive drum to a desired potential level. However, the higher the value of the AC voltage, the greater the force which causes the magnetic particles to adhere to the photosensitive drum, and therefore, the higher the speed with which the surface layer of the photosensitive member is shaved away. Therefore, the AC voltage has to be set to a value which is satisfactory in terms of both charging performance and speed with which the surface layer of the photosensitive member is shaved away. In this embodiment, the AC voltage was set to 500 V in peak-to-peak voltage. However, if it is not of concern that it is possible for the charging device to reduce in performance, the AC voltage may be reduce in peak-to-peak voltage to a value which is no more than 500 V to prevent the speed with which the surface layer of the photosensitive member is shaved away from drastically increasing.

As the AC voltage to be applied to the charging sleeve is reduced, the potential of the surface layer of the photosensitive drum reduces in convergence, which results in the formation of images of lower quality.

As a solution to this problem, it is possible to design an image forming apparatus so that it can be operated in the durability priority mode or image quality priority mode in order to make it possible for a user to select an operational mode based on a preset standard (permissible level) for image quality. In the drum durability priority mode, the photosensitive drum replacement intervals can be extended, while keeping below a preset value the amount by which the magnetic particles are used for outputting a preset number of prints, by slightly reducing the image forming apparatus in image quality.

When the image forming apparatus is in the drum durability priority mode, the AC voltage to be applied to the charging sleeve is slightly reduced in value to reduce the speed with which the surface layer of the photosensitive member is shaved away, whereas when the apparatus is in the image quality priority mode, the AC voltage to be applied to the charging sleeve is not changed in value. Therefore, it is possible to reduce in length the drum replacement intervals while keeping below a preset value the amount by which the magnetic particles are used for outputting a preset number of prints, in consideration of the primary concern regarding the usage of the image forming apparatus.

Further, even when the image forming apparatus is in the drum durability priority mode, the problem that the apparatus is reduced in image quality can be avoided by reducing the apparatus in output. All that is necessary to do when the AC voltage to be applied to the charging sleeve is low in value is to extend the length of time necessary for the potential of the surface layer of the photosensitive drum to reach a desired level, that is, to reduce the apparatus in process speed. As the apparatus is reduced in process speed, the length of time it takes for a given point of the peripheral surface of the photosensitive drum to be moved through the nip between the photosensitive drum and magnetic brush (magnetic particles) becomes longer, and therefore, even if the AC voltage to be applied to the charging sleeve is reduced, the given point is properly charged, and therefore, the apparatus does not reduce in image quality.

In this embodiment, the image forming apparatus was set so that as the value of $\Delta\mu$ exceeds a preset $\Delta\mu max$, the AC voltage is reduced in peak-to-peak voltage to 300 V, and the process speed is reduced to 270 mm/sec. With this setup, it became possible to keep the value of $\Delta\mu$ below a preset one to extend the photosensitive drum replacement intervals while keeping below a preset value the amount by which the magnetic particles are used for outputting a preset number of prints.

As described above, in this embodiment, the image forming apparatus was set so that the magnetic particles in its charging device are replaced with preset intervals even if the apparatus is frequently changed in operational mode, and also, that the amount by which the magnetic particles are replaced is controlled in response to the changes in the surface condition of the magnetic particles. Therefore, the apparatus is significantly shorter in downtime, that is, the period in which it cannot output prints.

As described above, in this embodiment, the CPU controls such operations as reducing the AC voltage in value, reducing the process speed, etc., based on the value of $\Delta\mu$, that is, the rate at which $\mu$ changes in value. Therefore, it is possible to extend the photosensitive drum replacement intervals, while keeping below a preset value the amount by which the magnetic particles are used for outputting a preset number of prints.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 144611/2009 and 113437/2010 filed Jun. 17, 2009 and May 17, 2010, respectively, which are hereby incorporated by reference.

What is claimed is:

1. An image forming apparatus comprising:

an image bearing member;

charging means, including a rotatable magnetic particle carrying member and electroconductive magnetic particles carried on said rotatable magnetic particle carrying member, for charging said image bearing member by contacting the magnetic particles to said image bearing member;

measuring means for measuring magnitudes of a first force in a first direction and a second force in a second direction which are produced in a contact region between said image bearing member and the magnetic particles, wherein the first direction and the second direction are independent from each other; and control means for controlling an image forming operation on the basis of the forces measured by said measuring means.

2. An apparatus according to claim 1, wherein the forces are measured under different conditions, and the measured forces are approximated in a linear function, and wherein the image forming operation is controlled on the basis of a gradient of the linear function.

3. An apparatus according to claim 2, further comprising adjusting means for adjusting a gap formed between said image bearing member and said magnetic particle carrying member, and wherein in the different conditions, the gap is made different by said adjusting means.

4. An apparatus according to claim 2, further comprising phase detecting means for detecting a rotation phase of said image bearing member, and wherein in the different conditions, the phase of said image bearing member during measurement of said measuring means is different.

5. An apparatus according to claim 2, further comprising phase detecting means for detecting a rotation phase of said image bearing member, and wherein in the different conditions, said measuring means measures the forces a plurality of times under the same phase of said image bearing member.

6. An apparatus according to claim 1, wherein the forces are measured under different conditions, and the measured forces are approximated in a linear function, and wherein the image forming operation is controlled on the basis of an intercept of the linear function.

7. An apparatus according to claim 6, further comprising adjusting means for adjusting a gap formed between said image bearing member and said magnetic particle carrying member, and wherein in the different conditions, the gap is made different by said adjusting means.

8. An apparatus according to claim 6, further comprising phase detecting means for detecting a rotation phase of said image bearing member, and wherein in the different conditions, the phase of said image bearing member during measurement of said measuring means is different.

9. An apparatus according to claim 1, further comprising exchanging means for exchanging the magnetic particles of said charging means, wherein the image forming operation includes exchange of the magnetic particles by said exchanging means.

10. An apparatus according to claim 9, wherein said control means controls an amount of exchange of the magnetic particles.

11. An apparatus according to claim 9, wherein said control means controls an interval of exchange of the magnetic particles.

12. An apparatus according to claim 1, wherein said control means controls a voltage applied to said charging means.

* * * * *